US006478556B2

(12) United States Patent
Choi et al.

(10) Patent No.: US 6,478,556 B2
(45) Date of Patent: Nov. 12, 2002

(54) ASYMMETRIC SCROLL COMPRESSOR

(75) Inventors: Se Heon Choi, Seoul (KR); Young Il Chang, Seoul (KR); Byeong Chul Lee, Seoul (KR); Yang Hee Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/737,938

(22) Filed: Dec. 18, 2000

(65) Prior Publication Data

US 2001/0006604 A1 Jul. 5, 2001

(30) Foreign Application Priority Data

Dec. 24, 1999 (KR) ..... 99-62034
Dec. 24, 1999 (KR) ..... 99-62036
Feb. 17, 2000 (KR) ..... 2000-7553

(51) Int. Cl.[7] ..... F04C 18/00
(52) U.S. Cl. ..... 418/55.2; 418/55.3; 418/55.1
(58) Field of Search ..... 418/55.2, 55.3, 418/55.1

(56) References Cited

U.S. PATENT DOCUMENTS 4,818,195 A * 4/1989 Murayama et al. ..... 418/55.1
5,318,424 A * 6/1994 Bush et al. ..... 418/55.2
5,683,237 A * 11/1997 Hagiwara et al. ..... 418/55.2
5,938,417 A * 8/1999 Takeo et al. ..... 418/55.2
6,053,715 A * 4/2000 Hirano et al. ..... 418/55.2
6,273,691 B1 * 8/2001 Morimoto et al. ..... 418/55.2

FOREIGN PATENT DOCUMENTS

JP 57-176381 * 10/1982 ..... 418/178
JP 58-128485 * 8/1983 ..... 418/15
JP 58-222901 * 12/1983 ..... 418/55.2
JP 59-063389 * 4/1984 ..... 418/55.2
JP 02-027182 * 1/1990 ..... 418/55.2
JP 02-245490 * 10/1990 ..... 418/55.2
JP 03-011103 * 1/1991 ..... 418/55.2
JP 05-223071 * 8/1993 ..... 418/55.2
JP 06-010857 * 1/1994 ..... 418/55.2

* cited by examiner

*Primary Examiner*—Thomas Denion
*Assistant Examiner*—Theresa Trieu
(74) *Attorney, Agent, or Firm*—Birch, Stewart, Kolasch & Birch, LLP

(57) ABSTRACT

Disclosed is an asymmetric scroll compressor. The compressor includes an orbiting scroll possessing a wrap which has an involute curve-shaped configuration, an Oldham ring arranged on a lower surface of the orbiting scroll to prevent the orbiting scroll from being reversely rotated, and a fixed scroll having a wrap which has an involute curve-shaped configuration and is engaged with the wrap of the orbiting scroll such that compression chambers are defined between the wraps of the orbiting and fixed scrolls by rotating motion of the orbiting scroll. The wrap of the fixed scroll further extends within the range of 180° than the wrap of the orbiting scroll in a direction where an involute curve extends. A center of a base circle of the orbiting scroll wrap is positioned within a region which ranges circumferentially between 30° in a direction where the existing orbiting scroll wrap is wound up and 60° in a direction where the existing orbiting scroll wrap is extended, when measured from a straight line connecting a center of a base circle of the existing orbiting scroll wrap with an outer end of the existing orbiting scroll wrap, and radially between 0.1 times and 0.5 times a rotating radius of the orbiting scroll wrap.

4 Claims, 16 Drawing Sheets

ASYMMETRIC SCROLL COMPRESSOR

BACKGROUND OF THE INVENTION

1. Field of the Invention

The present invention relates to an asymmetric scroll compressor, and more particularly, the present invention relates to an asymmetric scroll compressor which can minimize a reverse rotation torque of an orbiting scroll, keep constant a direction of force acting on an Oldham ring to prevent reversal of rotation toque of the orbiting scroll, and reduce to the minimum unbalanced force of discharging gas generated upon a discharging stroke.

2. Description of the Related Art

Generally, a compressor serves as a machine for compressing fluid such as air, refrigerant gas or the like. The compressor is composed of a power generating section for generating driving force and a compressing mechanism section for compressing gas using the driving force which is transferred from the power generating section. Compressors are generally divided into rotary compressors, reciprocating compressors and scroll compressors, depending upon structures of compressing mechanism sections.

FIG. 1 illustrates a compressing mechanism section of a scroll compressor. As shown in FIG. 1, a compressing mechanism section of a scroll compressor includes a frame 1. n orbiting scroll 4 which has a wrap 4*a* of an involute curve-shaped configuration, is seated on an upper surface of the framer. A fixed scroll 3 is coupled to the orbiting scroll 4 in such a way as to cover the orbiting scroll 4. The fixed scroll 3 is formed, on a lower surface thereof, with a wrap 3*a* which has an involute curve-shaped configuration, and is defined, at a center portion thereof, with a discharging hole 3*b*. The fixed scroll 3 and the orbiting scroll 4 cooperate with each other to define compression chambers P therebetween. A boss part 4*b* which is projectedly formed on a lower surface of the orbiting scroll 4, is connected with an eccentric part 2*a* of a rotation shaft 2 which in turn is connected with a power generating section (not shown).

An Oldham ring 30 for preventing rotation of the orbiting scroll 4 is disposed between the frame 1 and the orbiting scroll 4.

FIG. 2 illustrates in further detail a coupling relationship of the Oldham ring 30 As shown in FIG. 2, the Oldham ring 30 has a ring-shaped configuration. First and second keys 32 and 33 each having a square column-shaped configuration are projectedly formed on an upper surface of the Oldham ring 30 and located along a first straight line. Third and fourth keys 34 and 35 each having a square column shaped configuration are projectedly formed on a lower surface of the Oldham ring 30 and located along a second straight line which is orthogonal to the first straight line along which the first and second keys 32 and 33 are located.

The lower surface of the orbiting scroll 4 is defined, along the first straight line, with first and second key grooves 4*c* and 4*d*, in a manner such that the first and second keys 32 and 33 of the Oldham ring 30 are respectively fitted into the first and second key grooves 4*c* and 4*d*. Also, the upper surface of the frame 1 is defined, along the second straight line, with third and fourth key grooves 1*a* and 1*b*, in a manner such that the third and fourth keys 34 and 35 of the Oldham ring 30 are respectively fitted into the third and fourth key grooves 1*a* and 1*b*.

The Oldham ring 30 is disposed between the frame 1 and the orbiting scroll 4, so that the first and second keys 32 and 33 are respectively fitted into the first and second key grooves 4*c* and 4*d* of the orbiting scroll 4 and the third and fourth keys 34 and 35 are respectively fitted into the third and fourth key grooves 1*a* and 1*b* of the frame 1.

In the compressing mechanism section, if driving force is transferred from the power generating section to the rotation shaft 2, the orbiting scroll 4 which is secured to the rotation shaft 2, is orbited in a state wherein the orbiting scroll 4 is engaged with the fixed scroll 3 and prevented by the Oldham ring 30 from being rotated. By orbiting motion of the orbiting scroll 4, relative movement of the wraps 3*a* and 4*a* which are respectively formed on the fixed scroll 3 and the orbiting scroll 4 and each of which has the involute curve-shaped configuration, is induced, whereby it is possible to continuously intake, compress and discharge gas.

Hereinbelow, a compression principle of the scroll compressor will be described with reference to FIG. 3. By the fact that the fixed scroll 3 which has the wrap 3*a* of the involute curve-shaped configuration and the orbiting scroll 4 which has the wrap 4*a* of the involute curve-shaped configuration, are engaged with each other in a state wherein the wraps 3*a* and 4*a* have a phase difference of 180° therebetween, crescent-shaped compression chambers P are respectively created at opposite positions. In this situation, when the orbiting scroll 4 is orbited with respect to the fixed scroll 3 which is secured to the frame 1 in a state wherein the orbiting scroll 4 is prevented by the Oldham ring 30 from being rotated, as the compression chambers P are moved toward a center of the scroll compressor, volumes of the respective compression chambers P are reduced and thereby a compressing function of the scroll compressor is performed.

More concretely speaking this compressing procedure, refrigerant gas which is introduced into the scroll compressor, flows into the fixed scroll 3 through an intake port (not shown) which is defined through a side wall of the fixed scroll 3.

At this time, one part of the intaken gas flows into a first compression chamber P1 which is defined adjoining the intake port of the fixed scroll 3, and then, a compressing process is undertaken. At the same time, the other part of the intaken gas flows, along a guide passage which is defined through the fixed scroll 3, into a second compression chamber P2 which is defined directly opposite to the first compression chamber P1 to be placed at a 180° separation from the first compression chamber P1, and then, a compressing process is undertaken. As the orbiting scroll 4 is orbited, the refrigerant gas existing in the compression chambers P, which refrigerant gas is undertaken to be symmetrically and simultaneously compressed, is further compressed while being moved toward the center of the scroll compressor, and then, is discharged through the discharging hole 3*b* which is defined at the center portion of the fixed scroll 3.

On the other hand, in the case of an asymmetric scroll compressor, as can be readily seen from FIG. 4, by the fact that a wrap 5*a* of a fixed scroll 5 is formed in such a way as to be longer than a wrap 6*a* of an orbiting scroll 6 by 180° or less, it is possible to intake an increased amount of refrigerant gas into the same volume when compared to a conventional symmetric scroll compressor, whereby a stroke volume is raised. Also, because it is possible to prevent the refrigerant gas which is intaken into the compression chambers P, from being heated, an intake amount of the refrigerant gas can be further increased.

In the meanwhile, referring to FIG. 5, in the scroll compressor, a rotation torque of the orbiting scroll is calculated by an equation given below:

$$Mt=Ft\times\{\beta-r\cos(\delta e-\theta)\}$$

where Ft is gas force acting in a tangential direction, β is a distance from a center of the orbiting scroll to an application point of the gas force Ft, r is an eccentricity between a center of an end plate of the orbiting scroll and a center of a base circle of an involute curve of the orbiting scroll wrap, θ is a crank angle, and δbe is an eccentric angle which is measured at an outer end of the wrap toward a direction where the wrap is wound up.

In the case of a conventional symmetric scroll compressor, due to the fact that pressures in two compression chambers are the same with each other, since β is constant as ½ϵ (that is, a half of an orbiting radius) and r=0, the rotation torque acts in a constant direction and thereby, behavior of the orbiting scroll is stabilized.

On the contrary, in the case of a conventional asymmetric scroll compressor, while the gas force Ft is unchanged, a value of β moves in a positive or negative direction due to asymmetry in pressures of the compression chambers which asymmetry is caused by a difference in an amount of intaken gas. Thus, the rotation torque Mt also moves in the positive or negative direction while the orbiting scroll is orbited. As a consequence, the orbiting scroll vibrates in forward and reverse orbiting directions.

FIG. 6 is a diagram illustrating a relationship between force which acts on the orbiting scroll and the keys of the Oldham ring in the just above-described condition, FIG. 7 is a graph illustrating a rotation torque which is applied to the orbiting scroll while the orbiting scroll is orbited in the just above-described condition, and FIG. 8 is a graph illustrating force which is applied to the keys of the Oldham ring due to the rotation torque of the orbiting scroll.

As shown in FIGS. 6 through 8, by the fact that the rotation torque and the reverse rotation torque act on the orbiting scroll in the positive and negative directions, because one or both of the keys 32 and 33 of the Oldham ring apply contact force toward both sides thereof, behavior of the orbiting scroll 6 and the Oldham ring 30 is made unstable. Further, due to the fact that the keys 32 and 33 of the Oldham ring 30 are brought into contact with the orbiting scroll 6 in a state wherein they are respectively fitted into key grooves 6*b* and 6*c* which are defined in the orbiting scroll 6, vibration noise and contact wear are generated. Moreover, by vibration of the orbiting scroll 6 in the forward and reverse orbiting directions, gaps are created in the compression chambers and thereby pressure leakage is caused.

In addition, in the case of the symmetric scroll compressor, since both compression chambers have the same pressure, volumetric ratios (that is, compression ratios) of both compression chambers are the same with each other upon a discharging stroke. However, in the case of the asymmetric scroll compressor, since both compression chambers have different pressures, pressure leakage increasingly occurs from one compression chamber having a high pressure to the other compression chamber having a low pressure.

Consequently, even in the case that volumetric ratios of both compression chambers are designed to be the same with each other, at the point of time when the discharging process is actually undertaken, pressures of both compression chambers are differentiated from each other. By this, due to the fact that one compression chamber is excessively compressed and the other compression chamber is insufficiently compressed, fluid loss is provoked upon the discharging stroke, and according to this, unbalance in gas force is deepened. Thus, a problem is caused in that behavior of the orbiting scroll is made unstable.

SUMMARY OF THE INVENTION

Accordingly, the present invention has been made in an effort to solve the problems occurring in the related art, and an object of the present invention is to provide an asymmetric scroll compressor which can minimize a reverse rotation torque acting on an orbiting scroll in such a way as to stabilize behavior of the orbiting scroll, keep constant a direction of force acting on an Oldham ring in such a way as to stabilize behavior of the Oldham ring, and reduce to the minimum unbalanced force of discharging gas, generated upon a discharging stroke.

In order to achieve the above object, according to one aspect of the present invention, there is provided an asymmetric scroll compressor including an orbiting scroll having an end plate and a boss part which are concentrically formed and possessing a wrap which is formed on an upper surface of the end plate and has an involute curve-shaped configuration, an Oldham ring arranged on a lower surface of the orbiting scroll in such a way as to prevent the orbiting scroll from being rotated, and a fixed scroll covering an upper portion of the orbiting scroll and having a wrap which has an involute curve-shaped configuration and is engaged with the wrap of the orbiting scroll in a manner such that compression chambers are defined between the wraps of the orbiting and fixed scrolls by rotating motion of the orbiting scroll, the wrap of the fixed scroll further extending within the range of 180° than the wrap of the orbiting scroll in a direction where an involute curve extends, wherein a center of a base circle of the orbiting scroll wrap is positioned within a region which ranges circumferentially between 30° in a direction where the existing orbiting scroll wrap is extended and 60° in a direction where the existing orbiting scroll wrap is wound up, when measured from a straight line connecting a center of a base circle of the existing orbiting scroll wrap which center corresponds to a center of the end plate and the boss part, with an outer end of the existing orbiting scroll wrap, and radially between 0.1 times and 0.5 times a orbiting radius of the orbiting scroll wrap.

According to another aspect of the present invention, there is provided an asymmetric scroll compressor including an orbiting scroll having an end plate and a boss part which are concentrically formed and possessing a wrap which is formed on an upper surface of the end plate and has an involute curve-shaped configuration, an Oldham ring arranged on a lower surface of the orbiting scroll in such a way as to prevent the orbiting scroll from being rotated, and a fixed scroll covering an upper portion of the orbiting scroll and having a wrap which has an involute curve-shaped configuration and is engaged with the wrap of the orbiting scroll in a manner such that compression chambers are defined between the wraps of the orbiting and fixed scrolls by orbiting motion of the orbiting scroll, the wrap of the fixed scroll further extending within the range of 180° than the wrap of the orbiting scroll in a direction where an involute curve extends, wherein one of keys which are formed on upper surface of the Oldham ring, is positioned within a region which ranges circumferentially between 10° in a direction where the orbiting scroll wrap is extended and 80° in a direction where the orbiting scroll wrap is wound up, when measured from a straight line connecting a center of a base circle of the orbiting scroll wrap with an outer end of the orbiting scroll wrap.

According to still another aspect of the present invention, there is provided an asymmetric scroll compressor including an orbiting scroll having an end plate and a boss part which are concentrically formed and possessing a wrap which is formed on an upper surface of the end plate and has an involute curve-shaped configuration, an Oldham ring arranged on a lower surface of the orbiting scroll in such a way as to prevent the orbiting scroll from being rotated, and a fixed scroll covering an upper portion of the orbiting scroll and having a wrap which has an involute curve-shaped configuration and is engaged with the wrap of the orbiting scroll in a manner such that compression chambers are defined between the wraps of the orbiting and fixed scrolls by rotating motion of the orbiting scroll, the wrap of the fixed scroll further extending within the range of 180° than the wrap of the orbiting scroll in a direction where an involute curve extends, wherein, when assuming that a volumetric ratio designates a ratio between an intake volume and a volume upon undertaking discharge, a first volumetric ratio of a first compression chamber which is defined between an inner surface of the fixed scroll wrap and an outer surface of the orbiting scroll wrap, is made larger than a second volumetric ratio of a second compression chamber which is defined between an outer surface of the fixed scroll wrap and an inner surface of the orbiting scroll wrap.

According to yet still another aspect of the present invention, the first volumetric ratio of the first compression chamber is made larger than the second volumetric ratio of the second compression chamber by at least 0.1.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1:
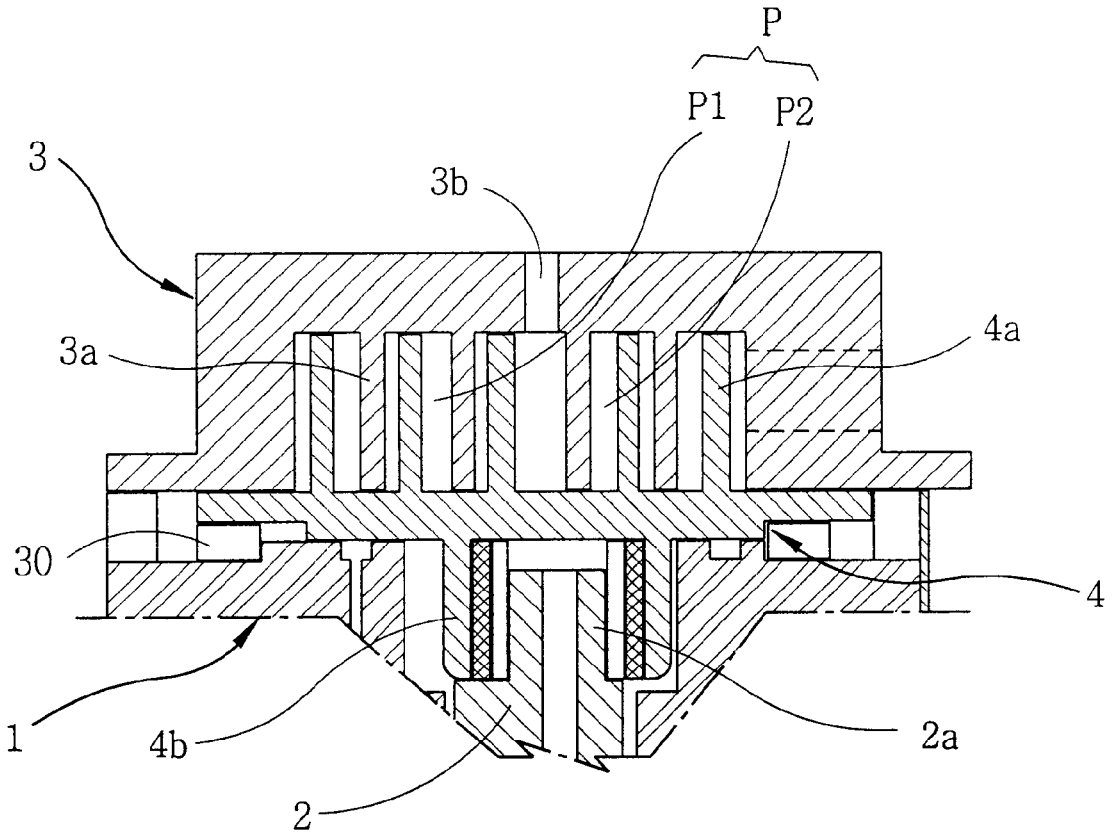
FIG. 1 CONVENTIONAL ART
FIG. 1 is a longitudinal cross-sectional view illustrating a compressing mechanism section of a conventional scroll compressor.
Figure 2:
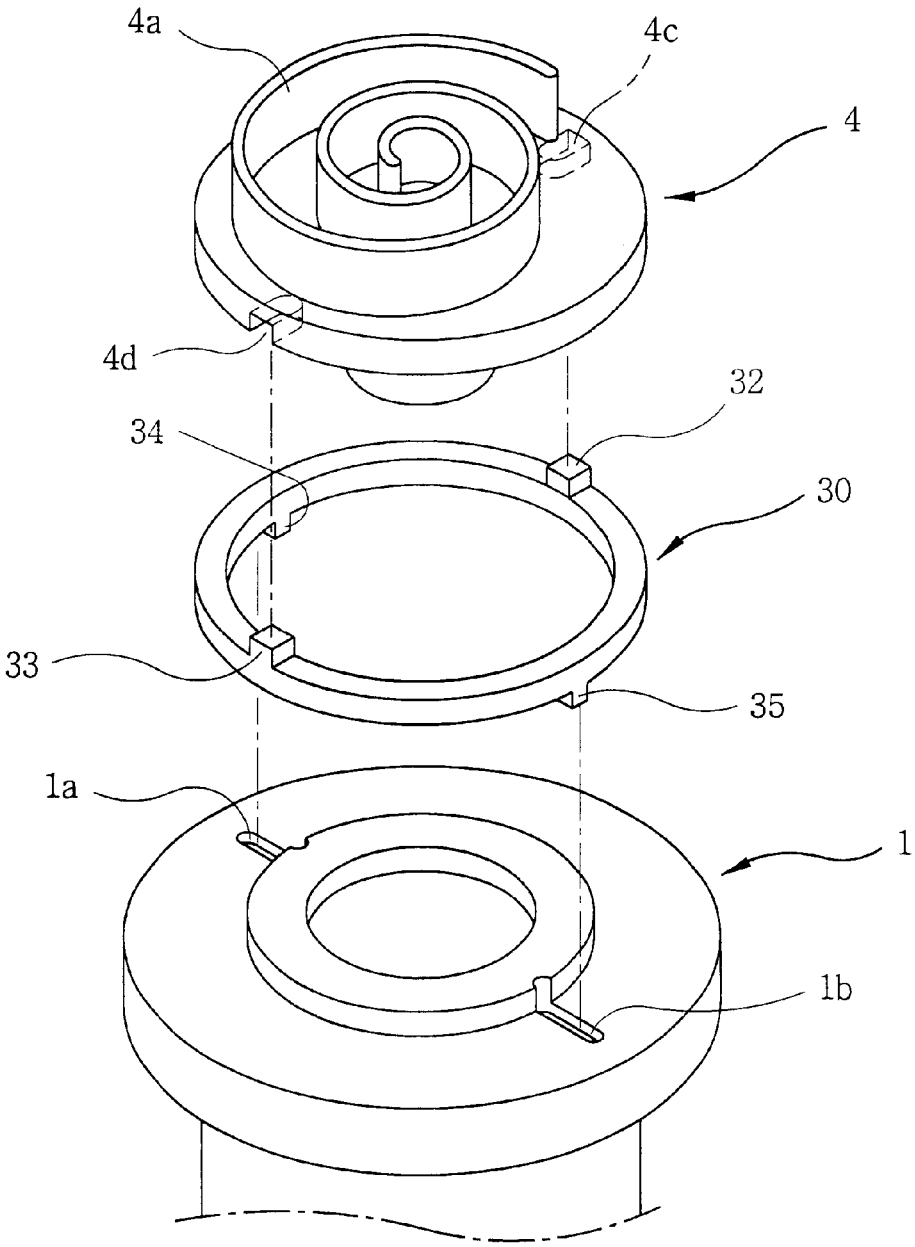
FIG. 2 CONVENTIONAL ART
FIG. 2 is an exploded perspective view illustrating main components of the compressing mechanism section of the conventional scroll compressor.
Figure 3:
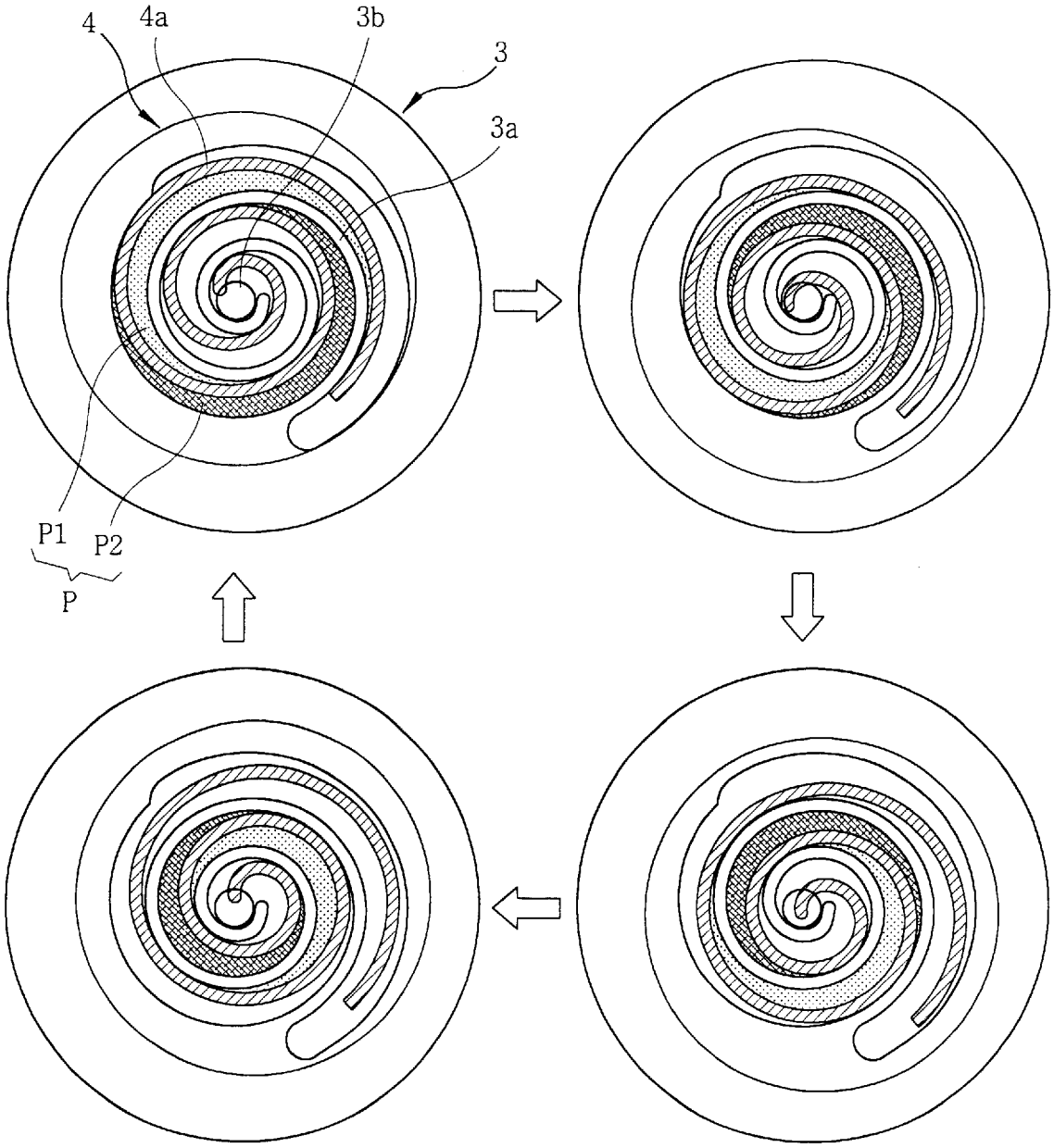
FIG. 3 CONVENTIONAL ART
FIG. 3 is of transverse cross-sectional views sequentially explaining a compression principle of a symmetric scroll compressor.
Figure 4:
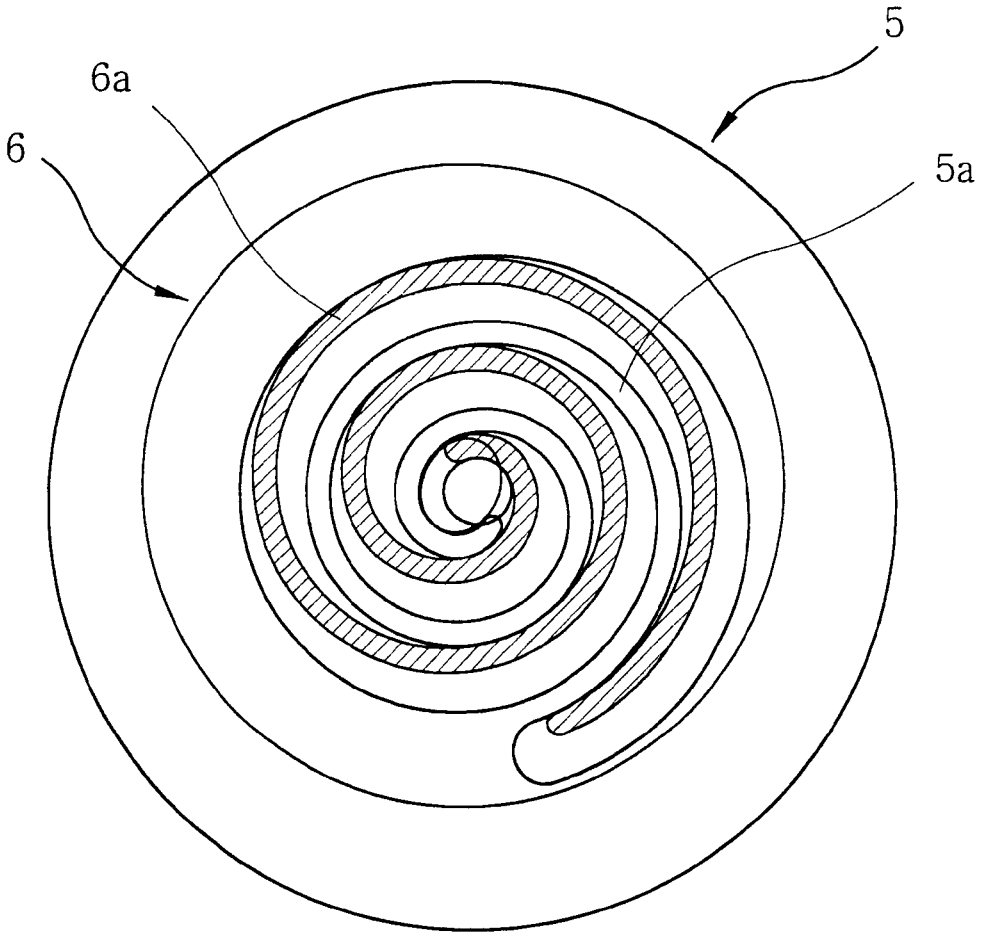
FIG. 4 CONVENTIONAL ART
FIG. 4 is a transverse cross-sectional view illustrating a compressing mechanism section of a conventional asymmetric scroll compressor.

Reference will now be made in greater detail to a preferred embodiment of the invention, an example of which is illustrated in the accompanying drawings.

Wherever possible, the same reference numerals will be used throughout the drawings and the description to refer to the same or like parts.

Figure 9:
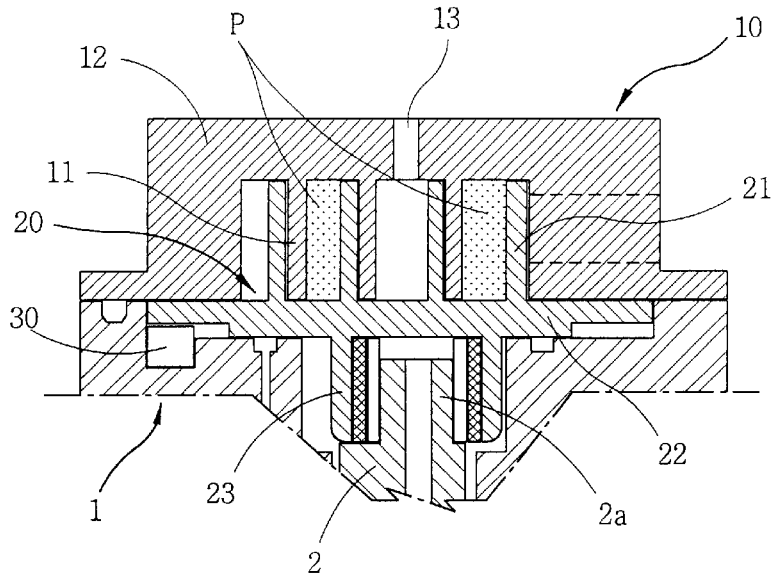
FIG. 9 is a longitudinal cross-sectional view illustrating a compressing mechanism section having a structure for preventing a reverse rotation torque from being generated, in an asymmetric scroll compressor in accordance with an embodiment of the present invention.
Figure 10:
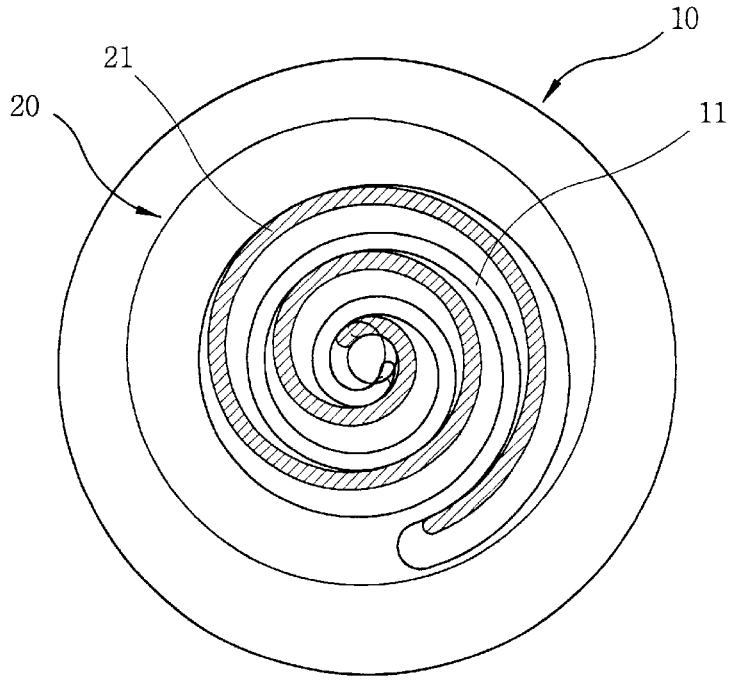
FIG. 10 is a transverse cross-sectional view illustrating the compressing mechanism section having the structure for preventing a reverse rotation torque from being generated, in the asymmetric scroll compressor in accordance with the embodiment of the present invention.

FIGS. 9 and 10 illustrate a compressing mechanism section of an asymmetric scroll compressor in accordance with an embodiment of the present invention.

Referring to FIGS. 9 and 10, the asymmetric scroll compressor is composed of a power generating section and a compressing mechanism section. The compressing mechanism section includes a fixed scroll 10 which is secured to a frame 1 and an orbiting scroll 20 which is intervened between the frame 1 and the fixed scroll 10 in such a way as to be capable of being orbited.

The fixed scroll 10 has a body 12 which is shaped to have a predetermined configuration. A wrap 11 which has an involute curve-shaped configuration, is formed on a lower surface of the body 12, and a discharging hole 13 is defined through a center portion of the body 12 of the fixed scroll 10.

The orbiting scroll 20 has an end plate 22 which possesses predetermined thickness and area. A wrap 21 which also has an involute curve-shaped configuration, is formed on an upper surface of the end plate 22, in a manner such that the wrap 21 of the rotation scroll 20 is engaged with the wrap 11 of the fixed scroll 10. A boss part 23 which is connected with an eccentric part 2*a* of a rotation shaft 2, is formed on a lower surface of the end plate 22.

By the fact that the eccentric part 2*a* of the rotation shaft 2 which is coupled with the power generating section, is inserted into the boss part 23 of the orbiting scroll 20, the orbiting scroll 20 is connected with the rotation shaft 2. Compression chambers P are defined between the wrap 11 of the fixed scroll 10 and the wrap 21 of the orbiting scroll 20.

The fixed scroll 10 and the orbiting scroll 20 are formed in a manner such that the orbiting scroll wrap 21 has the involute curve-shaped configuration and a predetermined length and the fixed scroll wrap 11 further extends by an involute angle of 180° or less than the orbiting scroll wrap 21 in a state wherein the fixed scroll wrap 11 is engaged with the orbiting scroll wrap 21.

Figure 11:
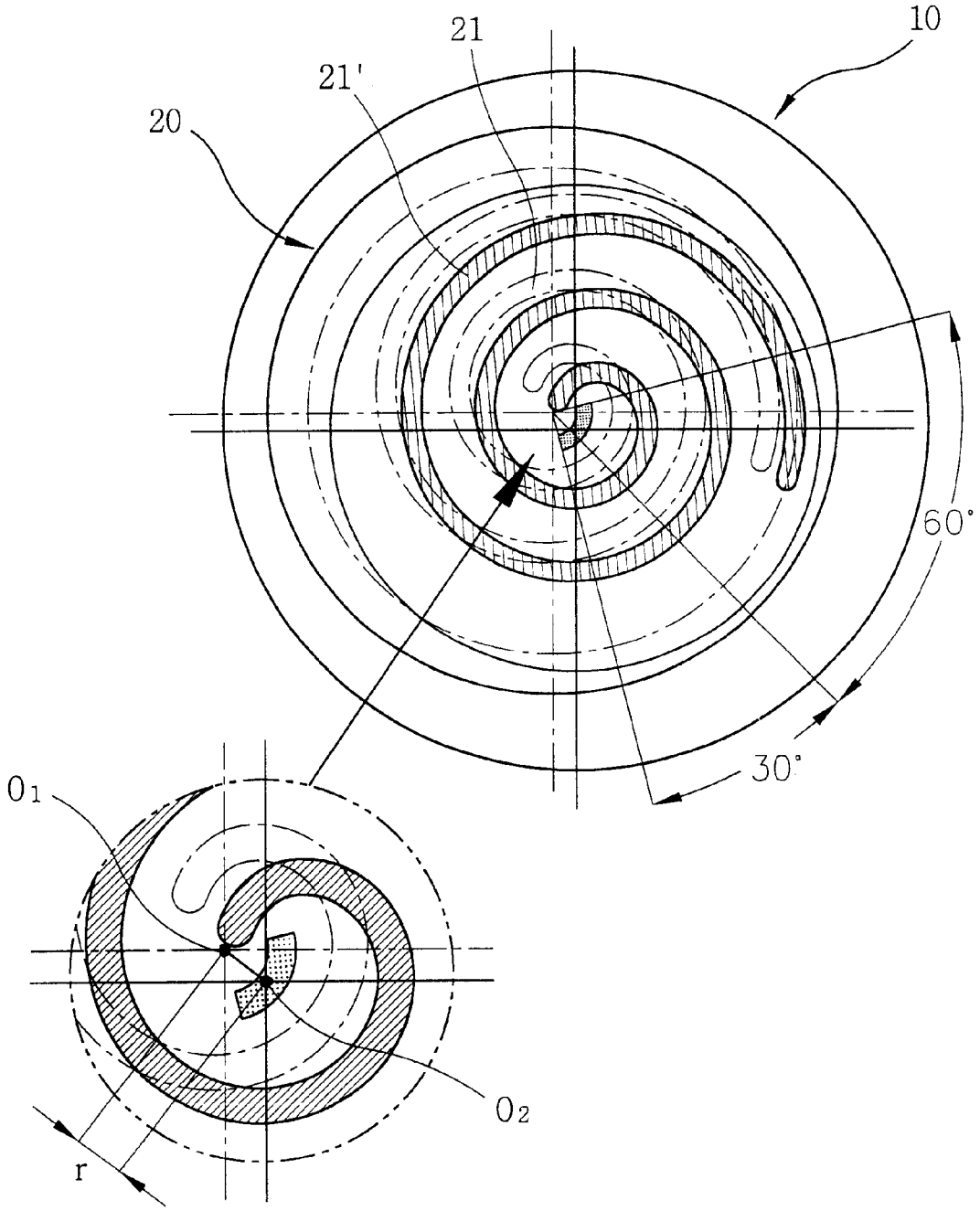
FIG. 11 is a partially enlarged transverse cross-sectional view illustrating an orbiting scroll which constitutes the structure for preventing a reverse rotation torque from being generated, in the asymmetric scroll compressor in accordance with the embodiment of the present invention.

Further, as shown in FIG. 11, a center $O_2$ of a base circle of an orbiting scroll wrap 21' is positioned within a region which ranges circumferentially between 30° in a direction where the existing orbiting scroll wrap 21 is extended and 60° in a direction where the existing orbiting scroll wrap 21 is wound up, when measured from a straight line connecting a center $O_1$ of a base circle of the existing orbiting scroll wrap 21 which center corresponds to a center of the end plate 22 and the boss part 23, with an outer end of the existing orbiting scroll wrap 21, and radially between 0.1 times and 0.5 times an orbiting radius of the orbiting scroll wrap 21.

Hereinafter, operations of the asymmetric scroll compressor in accordance with this embodiment of the present invention will be described.

First, if driving force is transferred from the power generating section through the rotation shaft 2 to the orbiting scroll 20, while the orbiting scroll 20 is prevented from being rotated by the Oldham ring 30 which is coupled to the end plate 22 of the orbiting scroll 20, the orbiting scroll 20 is orbited in a state wherein the fixed scroll wrap 11 and the orbiting scroll wrap 21 are engaged with each other. By orbiting motion of the orbiting scroll 20, refrigerant gas is intaken into the compression chambers P which are defined between the fixed scroll wrap 11 and the orbiting scroll wrap 21, compressed and then, discharged through the discharging hole 13 which is defined in the fixed scroll 10.

As aforementioned above, a rotation torque acting on the orbiting scroll is calculated by an equation as given below:

$$Mt=Ft\times\{\beta-r\cos(\delta e-\theta)\}$$

where Ft is gas force acting in a tangential direction, β is a distance from a center of the orbiting scroll to an application point of the gas force Ft, r is an eccentricity between the center of the end plate of the orbiting scroll and the center of the base circle of an involute curve of the orbiting scroll wrap, θ is a crank angle, and δe is an eccentric angle which is measured at the outer end of the wrap toward a direction where the wrap is extended.

Figure 5:
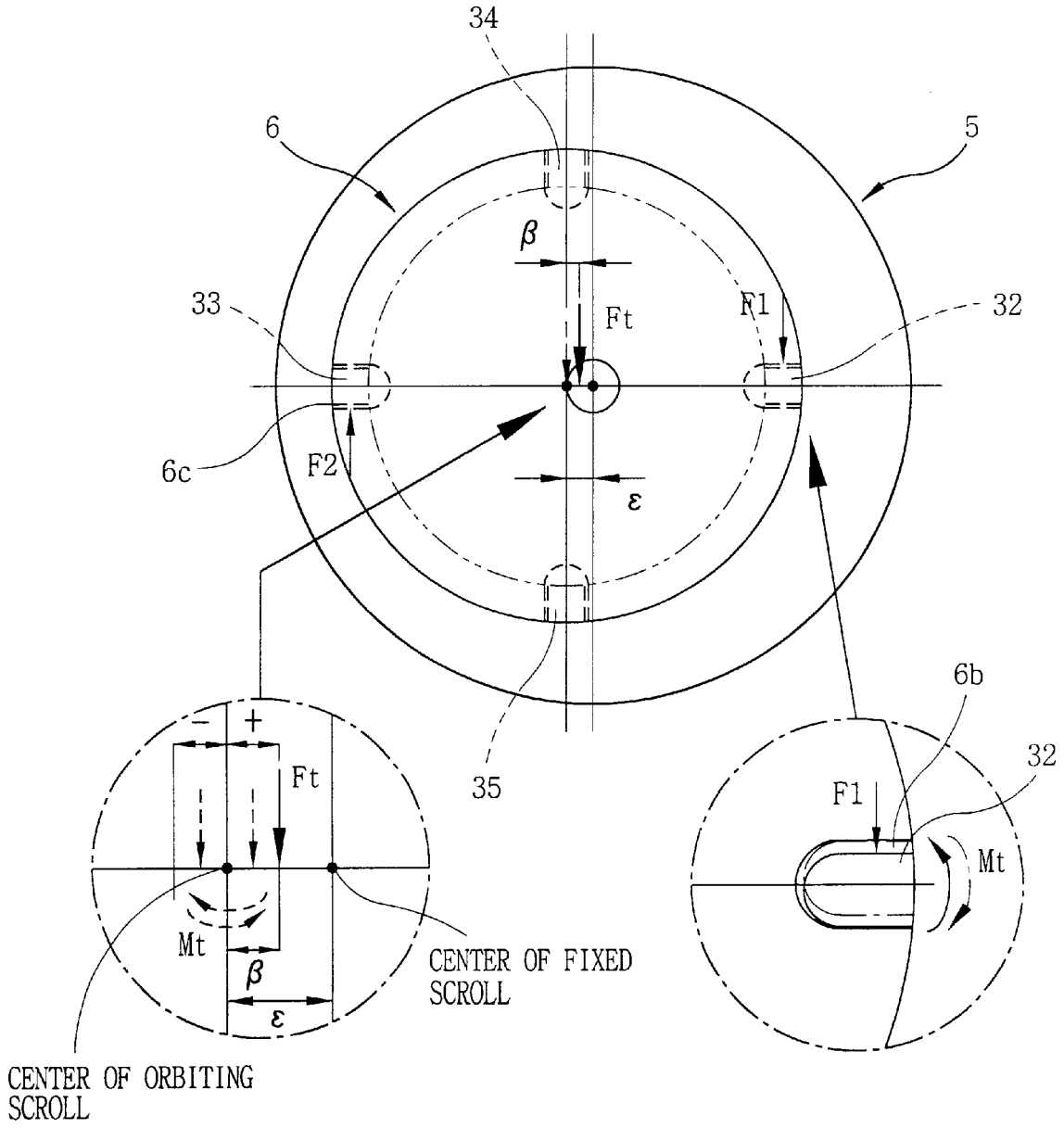
FIG. 5 CONVENTIONAL ART
FIG. 5 is a partially enlarged diagram illustrating a relationship of force acting on the conventional asymmetric scroll compressor.
Figure 6:
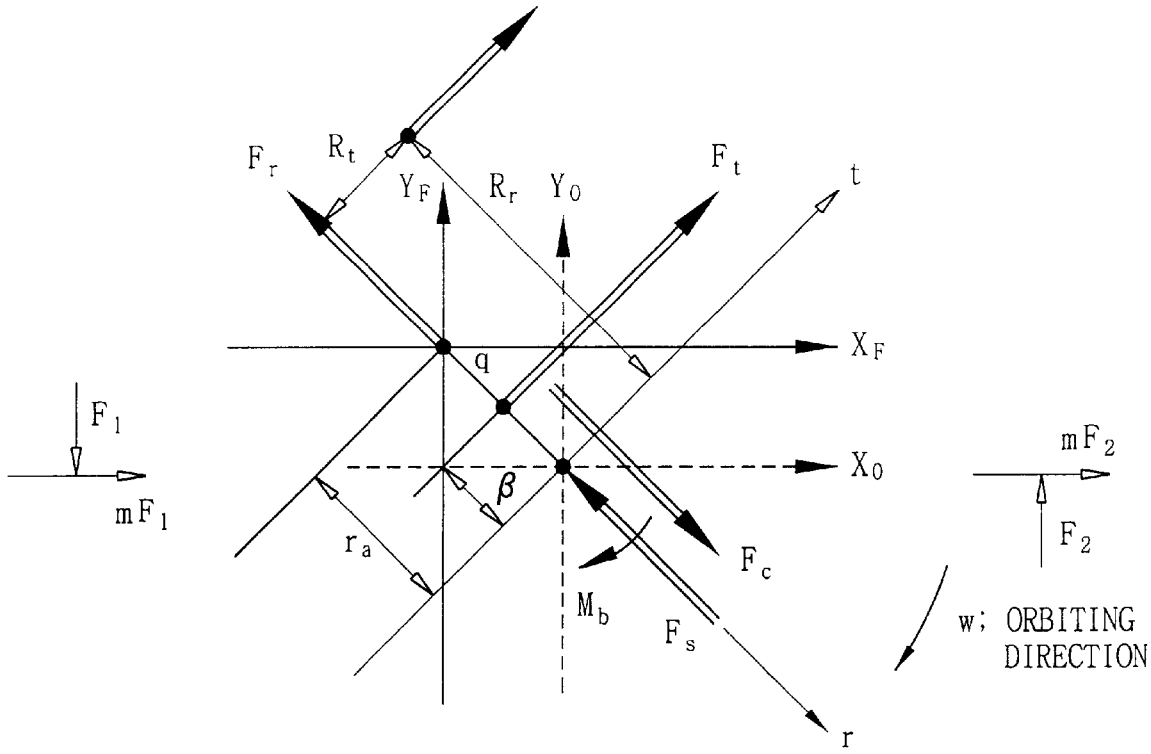
FIG. 6 CONVENTIONAL ART
FIG. 6 is a diagram illustrating a relationship of force acting on an orbiting scroll in the conventional asymmetric scroll compressor.
Figure 7:
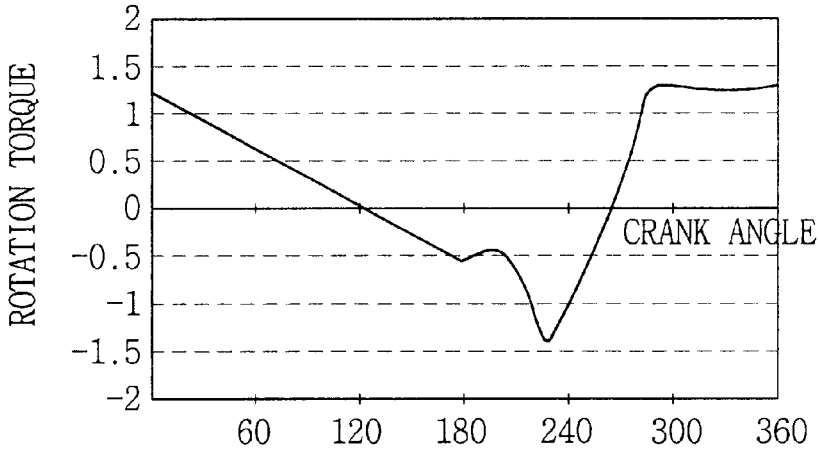
FIG. 7 CONVENTIONAL ART
FIGS. 7 and 8 are graphs respectively illustrating a rotation torque acting on the orbiting scroll and force acting on keys of an Oldham ring in the conventional asymmetric scroll compressor.
Figure 8:
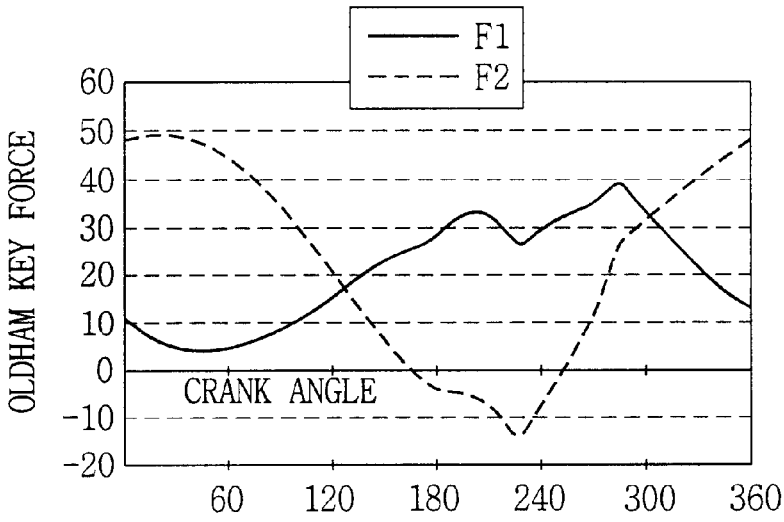
FIG. 8 CONVENTIONAL ART

In the above equation, a rotation torque component represented by Ft×β which is a term due to gas force acting in the tangential direction among terms used for determining the entire rotation torque of the orbiting scroll, has a tendency as shown in FIG. 5 depending upon a crank angle θ. Further, since δe is always constant, Ft×r×cos (δe −θ) which is a term due to an eccentricity of the wrap, has the form of a sine wave.

Accordingly, by properly adjusting the eccentricity r and the eccentric angle δe, it is possible to minimize reverse rotation of the orbiting scroll. In other words, by the fact that the center $O_2$ of the base circle of the orbiting scroll wrap is positioned within the region which ranges circumferentially between 30° in the direction where the existing orbiting scroll wrap is extended and 60° in the direction where the existing orbiting scroll wrap is wound up, when measured from the straight line connecting the center $O_1$ of the base circle of the existing orbiting scroll wrap which center corresponds to the center of the end plate and the boss part, with the outer end of the existing orbiting scroll wrap, and radially between 0.1 times and 0.5 times the rotating radius ϵ of the orbiting scroll wrap (that is, the center $O_2$ is deviated from the center $O_1$ by a distance corresponding to the eccentricity r), the reverse rotation torque acting on the orbiting scroll 20 is minimized.

Figure 12:
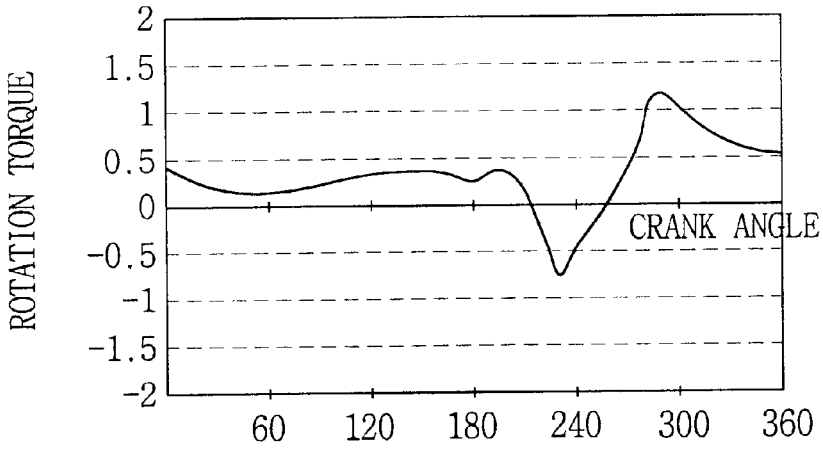
FIGS. 12 and 13 are graphs respectively illustrating a rotation torque acting on the orbiting scroll and force acting on keys of an Oldham ring in the asymmetric scroll compressor in accordance with the embodiment of the present invention.
Figure 13:
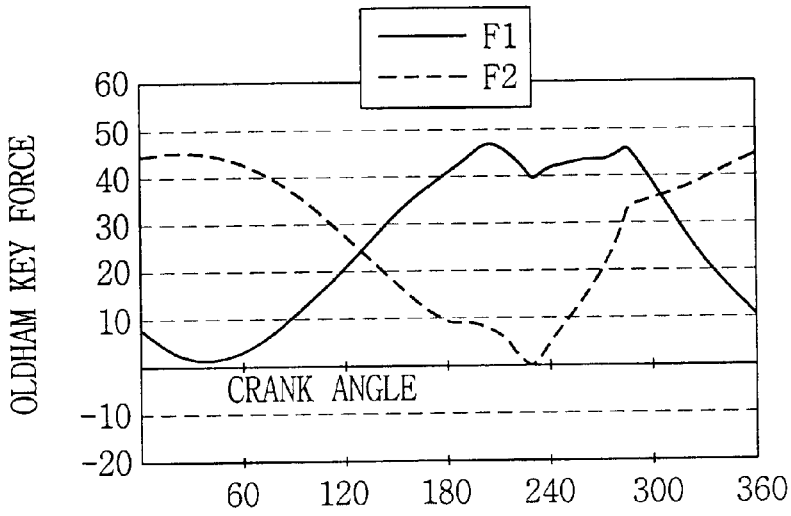

FIGS. 12 and 13 are graphs which illustrate results of calculations when using a structure for preventing a reverse rotation torque from being generated, in the asymmetric scroll compressor in accordance with this embodiment of the present invention.

By minimizing the reverse rotation torque acting on the orbiting torque as described above, a direction along which force is applied to the Oldham ring for preventing the orbiting scroll from being rotated, can be constantly maintained, whereby behavior of the orbiting scroll and the Oldham ring is stabilized.

Hereinbelow, an asymmetric scroll compressor in accordance with another embodiment of the present invention will be described with reference to the attached drawings.

Figure 14:
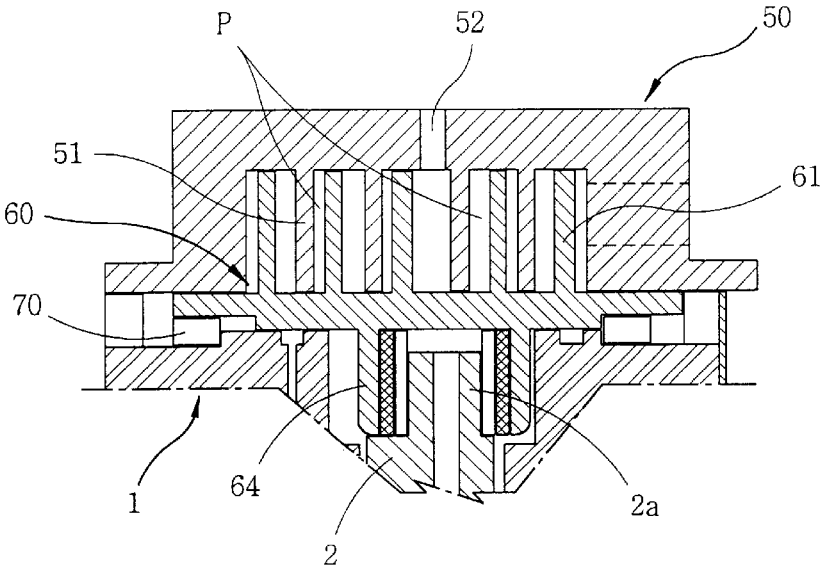
FIG. 14 is a longitudinal cross-sectional view illustrating a compressing mechanism section having a behavior stabilizing structure in an asymmetric scroll compressor in accordance with another embodiment of the present invention.
Figure 15:
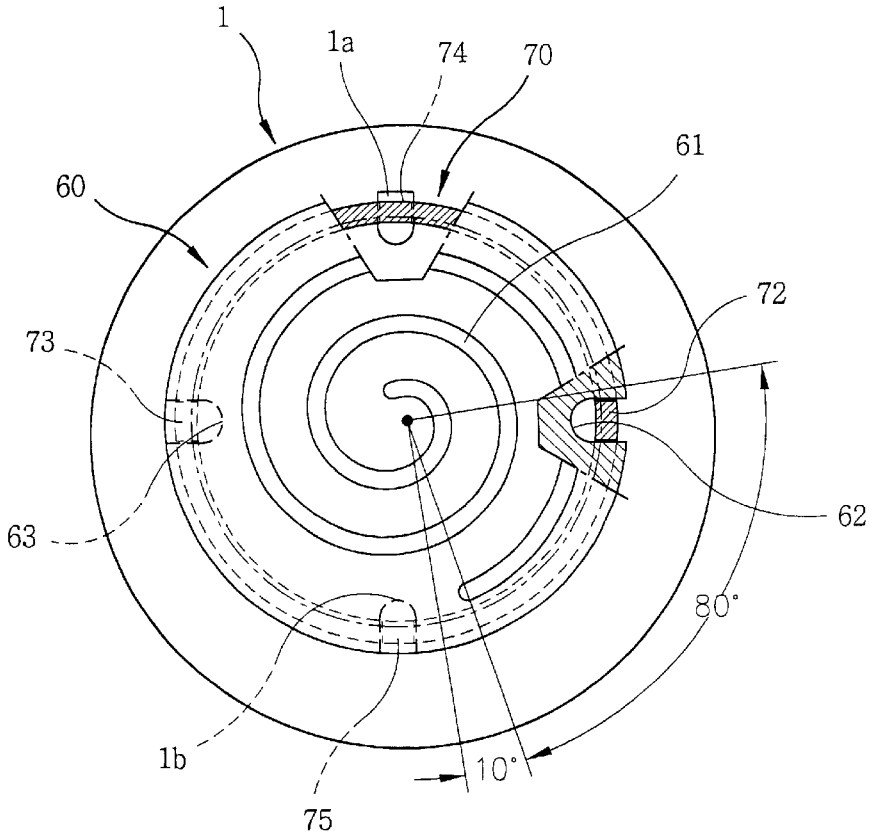
FIG. 15 is a transverse cross-sectional view illustrating the compressing mechanism section having the behavior stabilizing structure in the asymmetric scroll compressor in accordance with another embodiment of the present invention.

FIGS. 14 and 15 illustrate a compressing mechanism section of the asymmetric scroll compressor in accordance with another embodiment of the present invention. Referring to FIGS. 14 and 15, first, in the compressing mechanism section of the asymmetric scroll compressor, a fixed scroll 50 which is formed with a wrap 51 of an involute curve-shaped configuration, is coupled to a frame 1 having a predetermined configuration. An orbiting scroll 60 is intervened between the fixed scroll 50 and the frame 1 in a manner such that the orbiting scroll 60 can be orbited relative to the fixed scroll 50.

An Oldham ring 70 which serves to prevent the orbiting scroll 60 from being rotated, is interposed between the frame 1 and the orbiting scroll 60. The Oldham ring 70 is arranged in a manner such that one of keys which are formed on upper surface of the Oldham ring 70, is positioned within a region which ranges circumferentially between 10° in a direction where an orbiting scroll wrap 61 is extended and 80° in a direction where the orbiting scroll wrap 61 is wound up, when measured from a straight line connecting a center of a base circle of the orbiting scroll wrap 61 with an outer end of the orbiting scroll wrap 61.

Compression chambers P are defined between the wrap 51 of the fixed scroll 50 and the wrap 61 of the orbiting scroll 60. The fixed scroll wrap 51 further extends by an involute angle of 180° or less than the orbiting scroll wrap 61 in a state wherein the fixed scroll wrap 51 is engaged with the orbiting scroll wrap 61.

The Oldham ring 70 has a ring-shaped configuration. First and second keys 72 and 73 each having a square box-shaped configuration are projectedly formed on an upper surface of the Oldham ring 70 and located along a first straight line. Third and fourth keys 74 and 75 each also having a square box-shaped configuration are projectedly formed on a lower surface of the Oldham ring 70 and located along a second straight line which is orthogonal to the first straight line along which the first and second keys 72 and 73 are located.

The lower surface of the orbiting scroll 60 is defined, along the first straight line, with first and second key grooves (not shown), in a manner such that the first and second keys 72 and 73 of the Oldham ring 70 are respectively fitted into the first and second key grooves. Also, the upper surface of the frame 1 is defined, along the second straight line, with third and fourth key grooves (not shown), in a manner such that the third and fourth keys 74 and 75 of the Oldham ring 70 are respectively fitted into the third and fourth key grooves.

The Oldham ring 70 is disposed between the frame 1 and the orbiting scroll 60, so that the first and second keys 72 and 73 are respectively fitted into the first and second key grooves of the orbiting scroll 60 and the third and fourth keys 74 and 75 are respectively fitted into the third and fourth key grooves of the frame 1.

As described above, among the first and second keys 72 and 73 of the Oldham ring 70 and the first and second key grooves of the orbiting scroll 60, into which the first and second keys 72 and 73 are respectively fitted, one key and one key groove into which the one key is fitted, are positioned within the region which ranges circumferentially between 10° in the direction where the orbiting scroll wrap is extended and 80° in the direction where the orbiting scroll wrap is wound up, when measured from the straight line connecting the center of the base circle of the orbiting scroll wrap with the outer end of the orbiting scroll wrap. Then, remaining keys of the Oldham ring and remaining key grooves are properly arranged in a manner such that all of the keys and the key grooves are respectively spaced apart one from another by 90°.

By the fact that an eccentric part 2*a* of a rotation shaft 2 which is coupled with a power generating section, is inserted into a boss part 64 which is formed on a lower surface of the orbiting scroll 60, driving force is transferred from the power generating section through the rotation shaft 2 to the orbiting scroll 60.

Hereinafter, operations of the asymmetric scroll compressor in accordance with another embodiment of the present invention will be described.

First, if driving force is transferred from the power generating section through the rotation shaft 2 to the orbiting scroll 60, while the orbiting scroll 60 is prevented from being rotated by the Oldham ring 70, the orbiting scroll 60 is orbited in a state wherein the fixed scroll wrap 51 and the orbiting scroll wrap 61 are engaged with each other. By obriting motion of the orbiting scroll 60, refrigerant gas is intaken into compression chambers P which are defined by the fixed scroll wrap 51 and the orbiting scroll wrap 61. As the compression chambers P into which the refrigerant gas is intaken, are moved toward a center of the scroll compressor, volumes of the compression chambers P are decreased and thereby the refrigerant gas is compressed. Finally, the compressed refrigerant gas is discharged through a discharging hole 52 which is defined in the fixed scroll 50.

In the above procedure, the orbiting scroll 60 is orbited with a predetermined orbiting radius around a center of the fixed scroll 50 in a state wherein the orbiting scroll 60 is prevented by the Oldham ring 70 from being rotated.

Here, the most important elements among terms used for determining reaction force which is applied to the Oldham ring 70 by the orbiting motion of the orbiting scroll 60 so as to act against prevention of the rotation of the orbiting scroll 60, include influence by the rotation torque and sealing force, that is, force which squeezes the orbiting scroll 60 against the fixed scroll 50.

Between the two most important elements, the rotation torque is determined by configurations of the scrolls, and the sealing force is determined by a position of the Oldham ring.

The sealing force is calculated by equation of motion of the orbiting scroll. Centrifugal force Fc and tangential gas force Fr are main elements which have an effect on the sealing force. Values of trigonometrical function having a constant correlation according to orbited angle are multiplied to the centrifugal force Fc and tangential gas force Fr. Thus, the equation of motion of the orbiting scroll is represented a sine curve. The orbited angle has a constant correlation to the angle of the Oldham ring.

As a consequence, by the fact that, among the keys of the Oldham ring, one of the keys which are fitted into the key grooves of the orbiting scroll, is positioned within the region which ranges circumferentially between adequate angles, that is, between 10° in the direction where the orbiting scroll wrap is extended and 80° in the direction where the orbiting scroll wrap is wound up, when measured from the straight line connecting the center of the base circle of the orbiting scroll wrap with the outer end of the orbiting scroll wrap, reversal of the reaction force which is applied to the Oldham ring 70, is minimized, whereby behavior of the Oldham ring 70 and the orbiting scroll 60 is stabilized.

Figure 16:
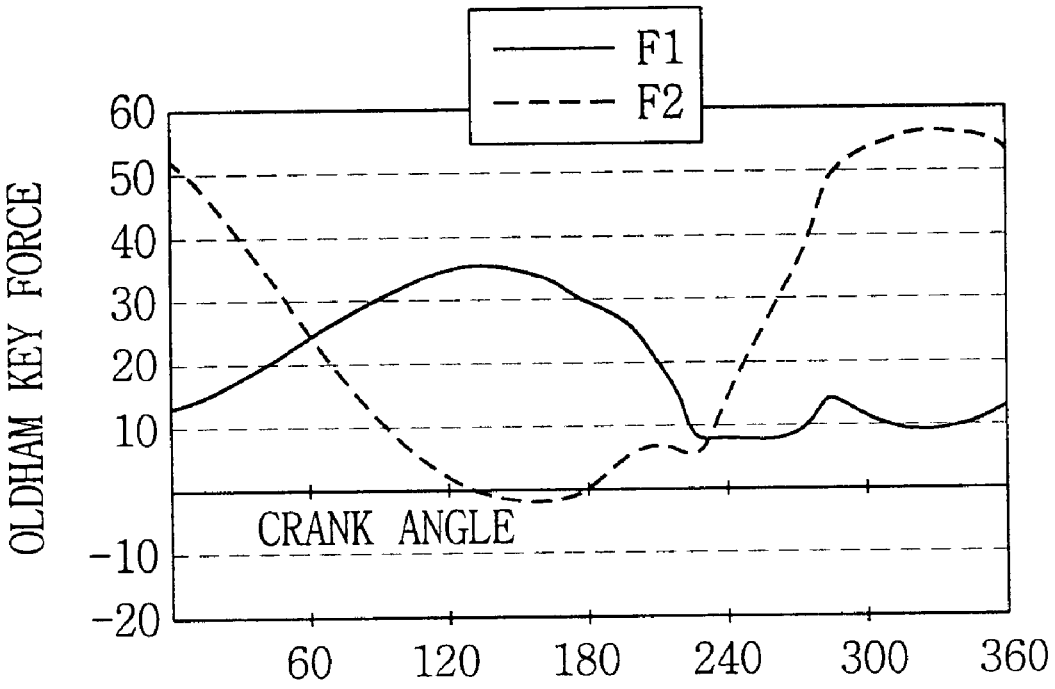
FIG. 16 is a graph illustrating force acting on keys of an Oldham ring in the asymmetric scroll compressor in accordance with another embodiment of the present invention.

FIG. 16 is a graph which illustrates force applied to the Oldham ring, as a result of an calculation using this embodiment of the present invention. As can be readily seen from the graph, reversal of the reaction force which is applied to the keys of the Oldham ring 70, is minimized, and the rotation torque which is applied to the Oldham ring 70 is minimized.

Hereinbelow, an asymmetric scroll compressor in accordance with still another embodiment of the present invention will be described with reference to the attached drawings.

Figure 17:
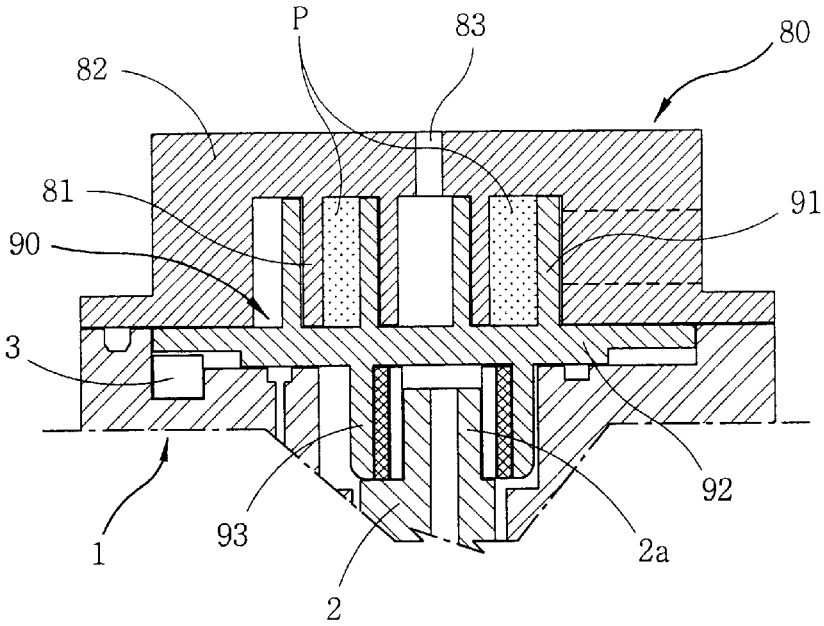
FIGS. 17 and 18 are respectively longitudinal and transverse cross-sectional views illustrating a compressing mechanism section having a gas discharging structure in an asymmetric scroll compressor in accordance with still another embodiment of the present invention.
Figure 18:
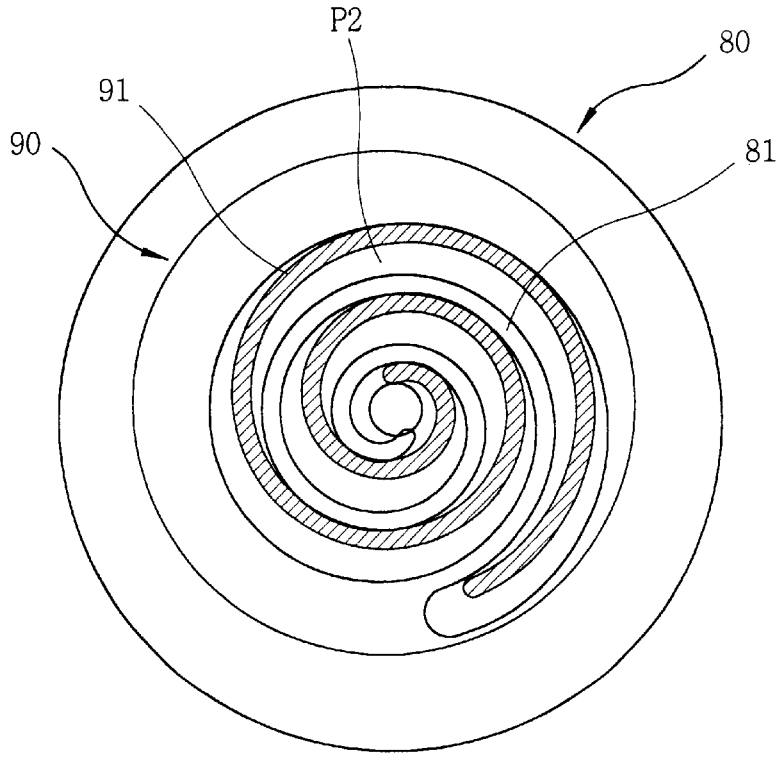

FIGS. 17 and 18 illustrate the asymmetric scroll compressor in accordance with still another embodiment of the present invention. Referring to FIGS. 17 and 18, first, the asymmetric scroll compressor is composed of a power generating section for generating driving force and a compressing mechanism section for receiving driving force from the power generating section and thereby compressing refrigerant gas. The compressing mechanism section includes a fixed scroll 80 which is secured to a frame 1 and an orbiting scroll 90 which is intervened between the frame 1 and the fixed scroll 80 in such a way as to be capable of being obited.

The fixed scroll 80 has a body which is shaped to have a predetermined configuration. A wrap 81 which has an involute curve-shaped configuration, is formed on a lower surface of the body, and a discharging hole 83 is defined through a center portion of the body of the fixed scroll 80.

The orbiting scroll 90 has an end plate 92 which possesses predetermined thickness and area. A wrap 91 which also has an involute curve-shaped configuration, is formed on an upper surface of the end plate 92, in a manner such that the wrap 91 of the orbiting scroll 90 is engaged with the wrap 81 of the fixed scroll 80. A boss part 93 which is connected with an eccentric part 2*a* of a rotation shaft 2, is formed on a lower surface of the end plate 92.

The orbiting scroll wrap 91 is engaged with the fixed scroll wrap 81 in a manner such that the orbiting scroll 90 can be orbiated. The fixed scroll wrap 81 is formed in such a way as to further extend by 180° than the orbiting scroll wrap 91.

A first volumetric ratio of a first compression chamber P1 which is defined between an inner surface of the fixed scroll wrap 81 and an outer surface of the orbiting scroll wrap 91, is made larger than a second volumetric ratio of a second compression chamber P2 which is defined between an outer surface of the fixed scroll wrap 81 and an inner surface of the orbiting scroll wrap 91.

Here, a volumetric ratio (that is, a compression ratio) is designated by a value which is obtained by dividing a volume of refrigerant gas intaken into a compression chamber when an intaking process is completed, with a volume of refrigerant gas when the refrigerant gas is undertaken to be discharged. That is, the volumetric ratio is represented by a ratio between an intake volume and a volume upon undertaking discharge. Here, it is preferred that the first volumetric ratio of the first compression chamber P1 is made larger than the second volumetric ratio of the second compression chamber P2 by at least 0.1.

Figure 19:
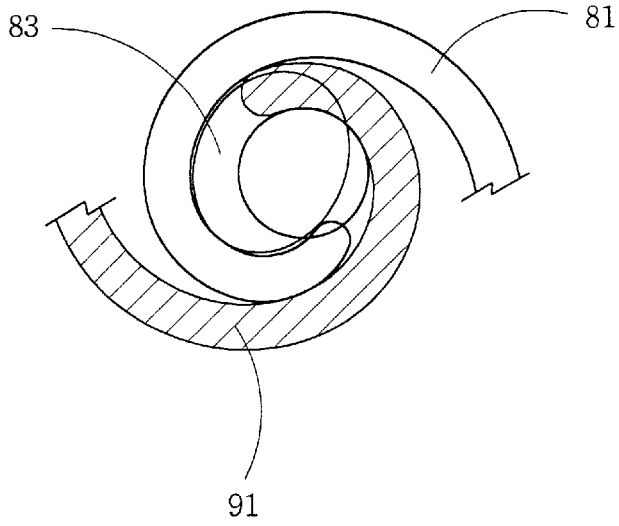
FIGS. 19 and 20 are transverse cross-sectional views illustrating the gas discharging structure in the asymmetric scroll compressor in accordance with still another embodiment of the present invention.
Figure 20:
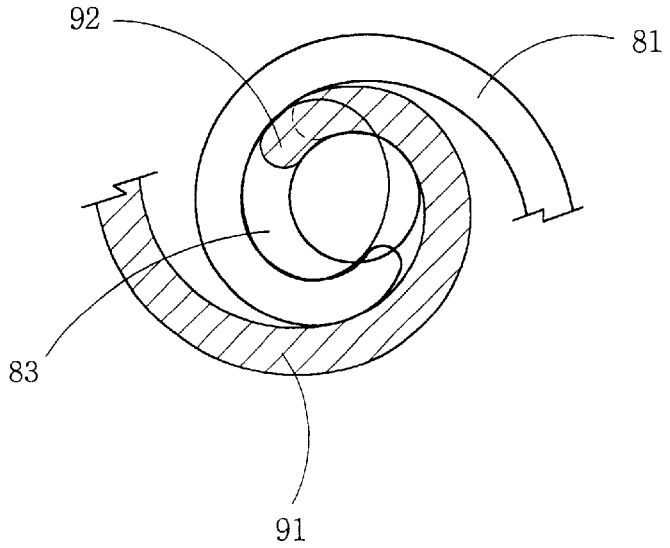
Figure 21:
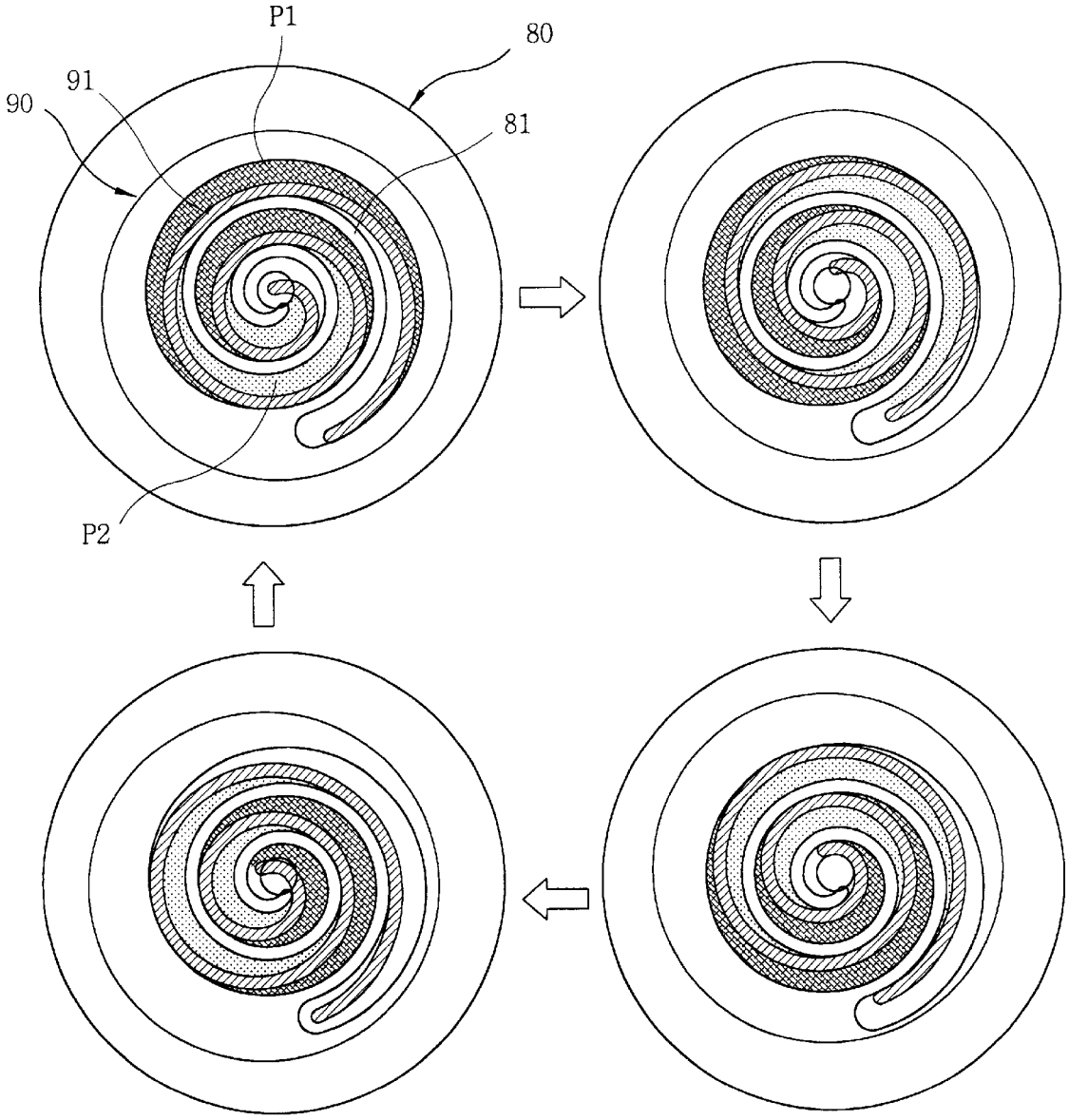
FIG. 21 is of transverse cross-sectional views successively illustrating operations of the gas discharging structure in the asymmetric scroll compressor in accordance with still another embodiment of the present invention.

FIGS. 19 and 20 illustrate configurations of inner ends of the fixed scroll wrap 81 and the orbiting scroll wrap 91 at a region of the discharging hole 83, so that the conventional structures and the present structures are comparatively explained with each other. As can be readily seen from FIGS. 19 and 20, as an example of an implement for making the first volumetric ratio of the first compression chamber P1 larger than the second volumetric ratio of the second compression chamber P2, the inner end of the orbiting scroll wrap 91 of the present invention is formed with an extended portion 92 and thereby further extends than the inner end of the conventional orbiting scroll wrap, in a manner such that discharge at the first compression chamber P1 is postponed or discharge at the second compression chamber P2 is advanced.

Hereinafter, operations of the asymmetric scroll compressor in accordance with still another embodiment of the present invention will be described.

First, if driving force is transferred from the power generating section through the rotation shaft 2 to the orbiting scroll 90, while the orbiting scroll 90 is prevented from being rotated by the Oldham ring 3 which is coupled to the end plate 92 of the orbiting scroll 90, the orbiting scroll 90 is orbiated in a state wherein the fixed scroll wrap 81 and the orbiting scroll wrap 91 are engaged with each other. By orbiting motion of the orbiting scroll 90, refrigerant gas is intaken into the compression chambers P1 and P2, compressed and then, discharged through the discharging hole 83 which is defined in the fixed scroll 80.

More concretely speaking this compressing procedure, after refrigerant gas which is introduced into the asymmetric scroll compressor through an intaking pipe, is first compressed, the refrigerant gas flows, adjacent to the outer end of the orbiting scroll wrap 91, into between the outer surface of the orbiting scroll wrap 91 and the inner surface of the fixed scroll wrap 81, in such a way as to define the first compression chamber P1. Then, as the orbiting scroll 90 is orbiated, a volume of the first compression chamber P1 is decreased, and a compressing process is simultaneously implemented. At the same time, the refrigerant gas flows into between the outer surface of the fixed scroll wrap 81 and the inner surface of the orbiting scroll wrap 91, in such a way as to define the second compression chamber P2.

Further, as the orbiting scroll 90 is continuously orbiated, the first and second compression chambers P1 and P2 which cooperatively define a pair in a state wherein they are oppositely located to each other, are moved toward a center of the scroll compressor. By this, volumes of the first and second compression chambers P1 and P2 are decreased. As a consequence, as the first and second compression chambers P1 and P2 are joined with each other at the region of the discharging hole 83 which is defined at the center portion of the fixed scroll 80, the compressed refrigerant gas is discharged through the discharging hole 83.

In the above procedure, due to the fact that the fixed scroll wrap 81 is formed in such a way as to be made longer than the orbiting scroll wrap 91 by 180° or less, an amount of refrigerant gas which is intaken into the first compression chamber P1, is made greater than an amount of refrigerant gas which is intaken into the second compression chamber P2, whereby a pressure of the first compression chamber P1 is made higher than a pressure of the second compression chamber P2.

Figure 22:
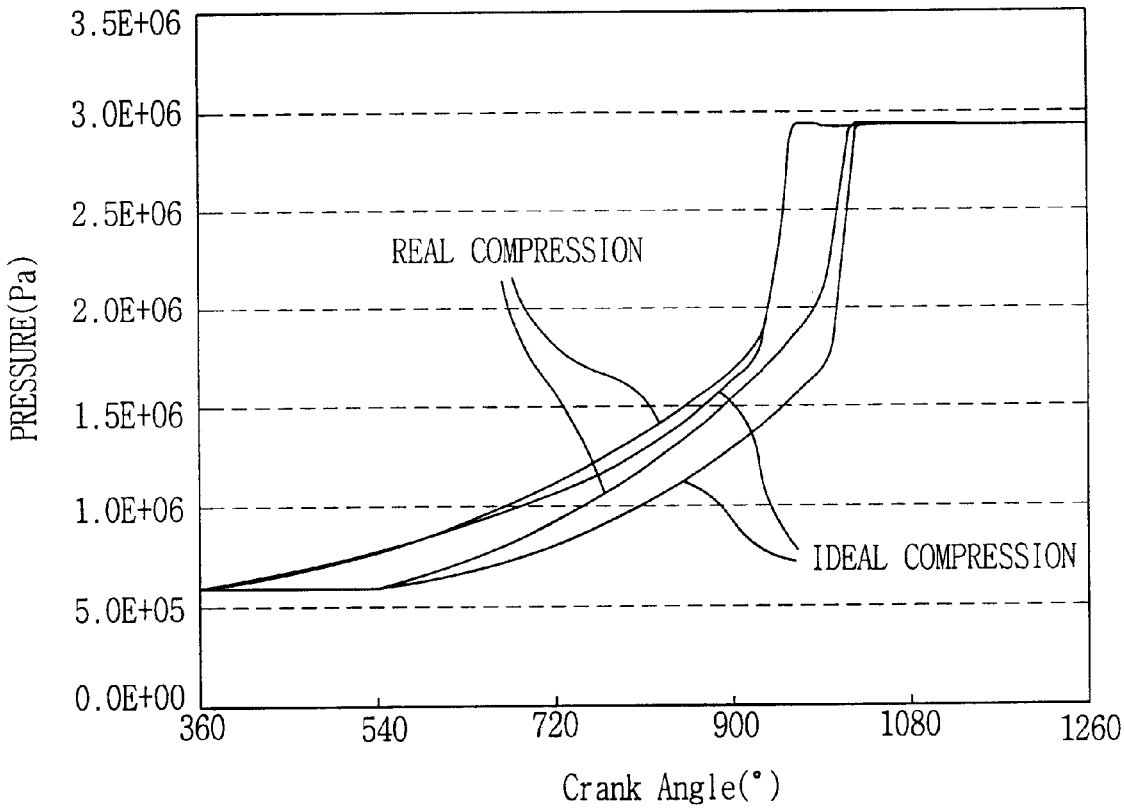
FIG. 22 is a graph illustrating a pressure of the asymmetric scroll compressor in accordance with still another embodiment of the present invention.

Generally, in the compressing mechanism section of the asymmetric type, as can be readily seen from FIG. 22, for ensuring the fact that behavior of the orbiting scroll 90 is stabilized when refrigerant gas compressed in the first and second compression chambers P1 and P2 is jointly discharged through the discharging hole 83, a first volumetric ratio (or a first compression ratio) of the refrigerant gas which is compressed while the first compression chamber P1 is moved toward the center of the scroll compressor and then is discharged through the discharging hole 83, must be the same as a second volumetric ratio (or a second compression ratio) of the refrigerant gas which is compressed while the second compression chamber P2 located in opposition to the first compression chamber P1 is moved toward the center of the scroll compressor and then is discharged through the discharging hole 83.

Here, while the first and second compression chambers P1 and P2 are compressed toward the discharging hole 83, if a pressure of the first compression chamber P1 leaks into the second compression chamber P2 due to a pressure difference between the first and second compression chambers P1 and P2 and then is discharged through the discharging hole 83, pressures of the discharging gas the first and second compression chambers P1 and P2 are differentiated from each other, whereby behavior of the entire scroll compressor is made unstable due to unbalance in gas force.

In this regard, in the present embodiment of the present invention, by the fact that the first volumetric ratio of the first compression chamber P1 is made larger than the second volumetric ratio of the second compression chamber P2, even though a pressure leakage occurs while the first and second compression chambers P1 and P2 are compressed, due to the largeness of the first volumetric ratio of the first compression chamber P1 in comparison with the second volumetric ratio of the second compression chamber P2, a difference between the pressure of the first compression chamber P1 and the pressure of the second compression chamber P2 when the refrigerant gas is discharged through the discharging hole 83, is minimized. In other words, as the first volumetric ratio of the first compression chamber P1 and the pressure of the second compression chamber P2 are made to be substantially the same with each other, balance in gas force is obtained when the refrigerant gas compressed in the first and second compression chambers P1 and P2 is jointly discharged through the discharging hole 83, whereby behavior of the orbiting scroll 90 is stabilized.

On the other hand, as another method, even in the case that the second volumetric ratio of the second compression chamber P2 is made smaller than the first volumetric ratio of the first compression chamber P1, the same functioning can be accomplished. In the compressing mechanism section of the asymmetric type, there exist a variety of factors which influence the volumetric ratios or compression ratios of the compression chambers P1 and P2.

For example, in the case of the first compression chamber P1, a length and a shape of the outer end of the orbiting scroll wrap 91, a contour of the discharging hole 83, or the like, can exert influence on the first volumetric ratio. In the case of the second compression chamber P2, a length and a shape of the outer end of the fixed scroll wrap 81, a contour of an intaking groove (not shown) defined at a center portion of the end plate 92 of the orbiting scroll 90, or the like, can exert influence on the second volumetric ratio.

Among the above-described factors, by increasing the length of the outer end of the orbiting scroll wrap 91, discharging time of the first compression chamber P1 can be delayed, whereby it is possible to increase the volumetric ratio of the first compression chamber P1.

As a result, by the asymmetric scroll compressor according to the present invention, advantages are provided in that, since a reverse rotation torque of an orbiting scroll is minimized and a rotation torque is applied in one direction to an Oldham ring which serves to prevent rotation of the orbiting scroll, behavior of the Oldham ring and the orbiting scroll is stabilized, whereby abnormal wear and vibration noise are avoided. Further, because leakage of compressed gas is prevented, operational reliability of the asymmetric scroll compressor is improved. Moreover, by the fact that pressures of compression chambers which are created while the orbiting scroll is orbiated, are balanced with each other, unbalance in force of discharging gas which are discharged through a discharging hole, is avoided and thereby, behavior of the orbiting scroll is stabilized, whereby the operational reliability of the asymmetric scroll compressor is further improved.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. An asymmetric scroll compressor including an orbiting scroll having an end plate and a boss part which are concentrically formed and possessing a wrap which is formed on an upper surface of the end plate and has an involute curve-shaped configuration, an Oldham ring arranged on a lower surface of the orbiting scroll in such a way as to prevent the orbiting scroll from being rotated, and a fixed scroll covering an upper portion of the orbiting scroll and having a wrap which has an involute curve-shaped configuration and is engaged with the wrap of the orbiting scroll in a manner such that compression chambers are defined between the wraps of the orbiting and fixed scrolls by rotating motion of the orbiting scroll, the wrap of the fixed scroll further extending within the range of 180° than the wrap of the orbiting scroll in a direction where an involute curve extends, wherein, when assuming that a volumetric ratio designates a ratio between an intake volume and a volume upon undertaking discharge, a first volumetric ratio of a first compression chamber which is defined between an inner surface of the fixed scroll wrap and an outer surface of the orbiting scroll wrap, is made larger than a second volumetric ratio of a second compression chamber which is defined between an outer surface of the fixed scroll wrap and an inner surface of the orbiting scroll wrap.

2. The asymmetric scroll compressor as claimed in claim 1, wherein the first volumetric ratio of the first compression chamber is made larger than the second volumetric ratio of the second compression chamber by at least 0.1.

3. An asymmetric scroll compressor including an orbiting scroll having an end plate and a boss part which are concentrically formed and possessing a wrap which is formed on an upper surface of the end plate and has an involute curve-shaped configuration, an Oldham ring arranged on a lower surface of the orbiting scroll in such a way as to prevent the orbiting scroll from being rotated, and a fixed scroll covering an upper portion of the orbiting scroll and having a wrap which has an involute curve-shaped configuration and is engaged with the wrap of the orbiting scroll in a manner such that compression chambers are defined between the wraps of the orbiting and fixed scrolls by rotating motion of the orbiting scroll, the wrap of the fixed scroll having a length which is longer than a length of the wrap of the orbiting scroll by approximately 180°, wherein when assuming that a volumetric ratio designates a ratio between an intake volume and a volume upon undertaking discharge, a first volumetric ratio of a first compression chamber which is defined between an inner surface of the fixed scroll wrap and an outer surface of the orbiting scroll wrap, is made larger than a second volumetric ratio of a second compression chamber which is defined between an outer surface of the fixed scroll wrap and an inner surface of the orbiting scroll wrap.

4. The asymmetric scroll compressor as claimed in claim 3, wherein the first volumetric ratio of the first compression chamber is made larger than the second volumetric ratio of the second compression chamber by at least 0.1.

* * * * *